US006024061A

United States Patent [19]

Adachi et al.

[11] Patent Number: 6,024,061

[45] **Date of Patent: *Feb. 15, 2000**

[54] VALVE TIMING ADJUSTING APPARATUS FOR INTERNAL COMBUSTION ENGINES

[75] Inventors: Michio Adachi, Obu; Kenji Ueda, Kariya, both of Japan

[73] Assignee: Denso Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/015,305

[22] Filed: Jan. 29, 1998

[30] Foreign Application Priority Data

Jan. 31, 1997 [JP] Japan ..... 9-018826

[51] Int. Cl.[7] ..... F01L 1/344

[52] U.S. Cl. ..... 123/90.17; 123/90.31; 74/568 R; 464/2

[58] Field of Search ..... 123/90.12, 90.15, 123/90.17, 90.31; 74/567, 568 R; 464/1, 2, 160

[56] References Cited

U.S. PATENT DOCUMENTS

| | | | |
|---|---|---|---|
| 4,858,572 | 8/1989 | Shirai et al. | 123/90.15 |
| 5,107,804 | 4/1992 | Becker et al. | 123/90.17 |
| 5,469,818 | 11/1995 | Yoshioka et al. | 123/90.17 |
| 5,522,352 | 6/1996 | Adachi et al. | 123/90.17 |
| 5,562,071 | 10/1996 | Urushihata et al. | 123/90.17 |
| 5,628,286 | 5/1997 | Kato et al. | 123/90.17 |
| 5,666,914 | 9/1997 | Ushida et al. | 123/90.17 |

FOREIGN PATENT DOCUMENTS

| | | | |
|---|---|---|---|
| 0 799 976 A1 | 10/1997 | European Pat. Off. . | |
| 1-92504 | 4/1989 | Japan . | |
| 2-50105 U | 4/1990 | Japan . | |
| 5-195726 | 8/1993 | Japan . | |
| 6-712 | 1/1994 | Japan . | |
| 2302391 | 1/1997 | United Kingdom | 123/90.17 |

*Primary Examiner*—Weilun Lo
*Attorney, Agent, or Firm*—Nixon & Vanderhye PC

[57] ABSTRACT

A valve timing adjusting apparatus that selectively controls a restraint mechanism for restraining relative rotation between a housing member and a vane member to increase the operational life thereof. When a vane rotor is held at a most lagging angular position, an end holding mode is executed to pull out a stopper piston from a stopper hole by fluid pressures of both a leading angle side and a lagging angle side. As a result, when the vane rotor rotates from the most lagging angular position to the leading angle side, torsional forces on the stopper piston and the stopper hole can be minimized as the vane member direction of rotation changes. Since a fluid pressure has already been applied to each of leading angle fluid pressure chambers in the end holding mode, the vane rotor can be rotated from the most lagging angular position to the leading angle side quickly by increasing fluid pressure applied to each of the leading angle fluid pressure chambers without the need to switch a fluid path. In addition, since the fluid pressure applied to each of the leading angle fluid pressure chambers in the end holding mode is smaller than fluid pressure for rotating the vane rotor to the leading angle side, generation of impact sound due to collisions of vanes can be avoided.

17 Claims, 8 Drawing Sheets

FIRST EMBODIMENT

SECOND EMBODIMENT

VALVE TIMING ADJUSTING APPARATUS FOR INTERNAL COMBUSTION ENGINES

CROSS-REFERENCE TO RELATED APPLICATION

This application is related to and claims priority from Japanese Patent Application No. Hei 9-18826 filed on Jan. 31, 1997, the contents of which are hereby incorporated by reference.

BACKGROUND OF THE INVENTION

1. Field of the Invention

The present invention relates to a valve timing adjusting apparatus for changing opening/closing timing (referred to hereafter simply as valve timing) of at least one of an intake valve and an exhaust valve of an internal combustion engine (referred to hereafter simply as an engine).

2. Description of Related Art

A vane type valve timing adjusting apparatus for controlling the valve timing of at least one of an intake valve and an exhaust valve is well known. Typically, the apparatus operates by driving a camshaft through a timing pulley or a chain sprocket rotating in synchronization with a crank shaft of the engine in accordance with a difference in phase between the camshaft and the timing pulley or the chain sprocket. Such an apparatus is disclosed in Japanese Patent Laid-open No. Hei 1-92504.

In the valve timing adjusting apparatus disclosed in Japanese Patent Laid-open No. Hei 1-92504, a hole is provided on an internal rotor which is a rotary body on the camshaft side rotating along with a vane. A knock pin that can be fit in the hole is provided on the timing pulley, a rotary body on the crank shaft side. When the camshaft comes to an optimum position or an optimum angle with respect to the timing pulley, the knock pin is fit in the hole to restrain relative rotation between the two rotary bodies. As a result, when the camshaft is positioned at the most lagging angular position or the most leading angular position with respect to the timing pulley, it is possible to prevent sound from being generated due to an impact of the vane on the timing pulley even if a positive or negative change in torque is applied to the camshaft according to the driving of either an intake valve or an exhaust valve.

In order to change the phase of the camshaft relative to the timing pulley from the state where the knock pin is fit in the hole, a hydraulic path needs to be changed to pull out the knock pin from the hole so that the timing pulley can rotate relative to camshaft.

However, a vane-type valve timing adjusting apparatus such as that described above typically adopts a technique that causes the knock pin to be pulled out from the hole by an oil pressure to drive the vane to the leading angle side at the same time as the camshaft. The camshaft, which is located at a most lagging angular position with respect to the timing pulley, is then also rotated forward toward the leading angleside. Before the knock pin is pulled out from the hole, the internal rotor may start to rotate in some cases depending upon the timing of oil application to the vane and the knock pin. As a result, a force generated by the rotation of the internal rotor may be applied to the knock pin, causing a damage to the knock pin and members around the knock pin.

In addition, the knock pin is pulled out from the hole and the camshaft is rotated to the leading or lagging angle side after the hydraulic path is changed. As a result, it is often difficult to improve the response characteristic of phase control of the camshaft with respect to the timing pulley.

SUMMARY OF THE INVENTION

It is thus an object of the present invention to provide a valve timing adjusting apparatus that provides a restraint mechanism that restrains rotation of a vane member relative to a housing member according to a programmable timing pattern and that has an excellent response characteristic.

It is another object of the present invention to provide a valve timing adjusting apparatus that can be manufactured with ease.

According to a valve timing adjusting apparatus provided by the present invention, a first oil pressure in an end holding mode for holding a vane member at one circumferential direction end of an accommodation chamber for accommodating a vane member is lower than the first oil pressure in a first rotating mode for rotating the vane member to the other circumferential direction end of the accommodation chamber. Thus, a restrained state, described below, is removed by a pressure including the first fluid pressure in the end holding mode, resisting an energization force.

The restrained state is instead imposed by an engaging portion of a housing member. The engaging portion, including the accommodation chamber on an engaged portion of the vane member, is removed before the vane member is moved from one of the circumferential direction ends to the other circumferential direction end of the accommodation chamber. Thus, the engaging portion does not damage the engaged portion due to the rotation of the vane member relative to the housing member caused by the engaging portion being in contact with the engaged portion.

Furthermore, even with the restrained state of the engaging portion and the engaged portion removed in the end holding mode, the vane member is pushed toward a circumferential direction because the first oil pressure in the end holding mode is lower than the first oil pressure in the first mode. As a result, the vane member can be prevented from coming into contact with the housing member even if a positive or negative change in torque is applied to a driven shaft at one of the circumferential ends.

In addition, in the end holding mode, the restrained state imposed by the engaging portion on the engaged portion is removed in advance and the first oil pressure is applied to the vane member. Thus, by merely increasing the first oil pressure, the vane member can be rotated toward the other circumferential direction end at a high speed without the need to change a hydraulic path. As a result, the response characteristic of switching of the control mode from the end holding mode to the first mode is improved.

Desirable is the fact that, since the restrained state imposed by the engaging portion on the engaged portion can be removed by using only the first oil pressure, it is necessary to merely provide a pressure receiving surface for receiving a pressure in a direction of removing the restrained state on the engaging portion only for the first oil pressure. As a result, the engaging portion can be manufactured with ease and the manufacturing cost can also be reduced. Moreover, since the area of the pressure receiving surface can be increased, the restrained state imposed by the engaging portion on the engaged portion can be removed with a high degree of reliability even in the case of a low first oil pressure.

Also desirable is the fact that the restrained state imposed by the engaging portion on the engaged portion can be removed with a high degree of reliability even in the event of a low pressure like one during an idle driving operation.

Also desirable is the fact that the vane member can be held at a position other than at one of the circumferential direction ends with a high degree of reliability without the need to put the vane member in a rotating state relative to the housing member.

Also desirable is the fact that, by providing a second mode for rotating the vane member to the one of the circumferential direction ends, phase control in both directions toward a leading angle side and a lagging angle side of the vane member relative to the housing member can be carried out with a high degree of accuracy.

BRIEF DESCRIPTION OF THE DRAWINGS

Embodiments of the present invention will be described by referring to the following diagrams wherein.

DETAILED DESCRIPTION OF THE PREFERRED EMBODIMENTS

The preferred embodiments of the present invention with reference to the accompanying diagrams.

(FIRST EMBODIMENT)

Figure 1:
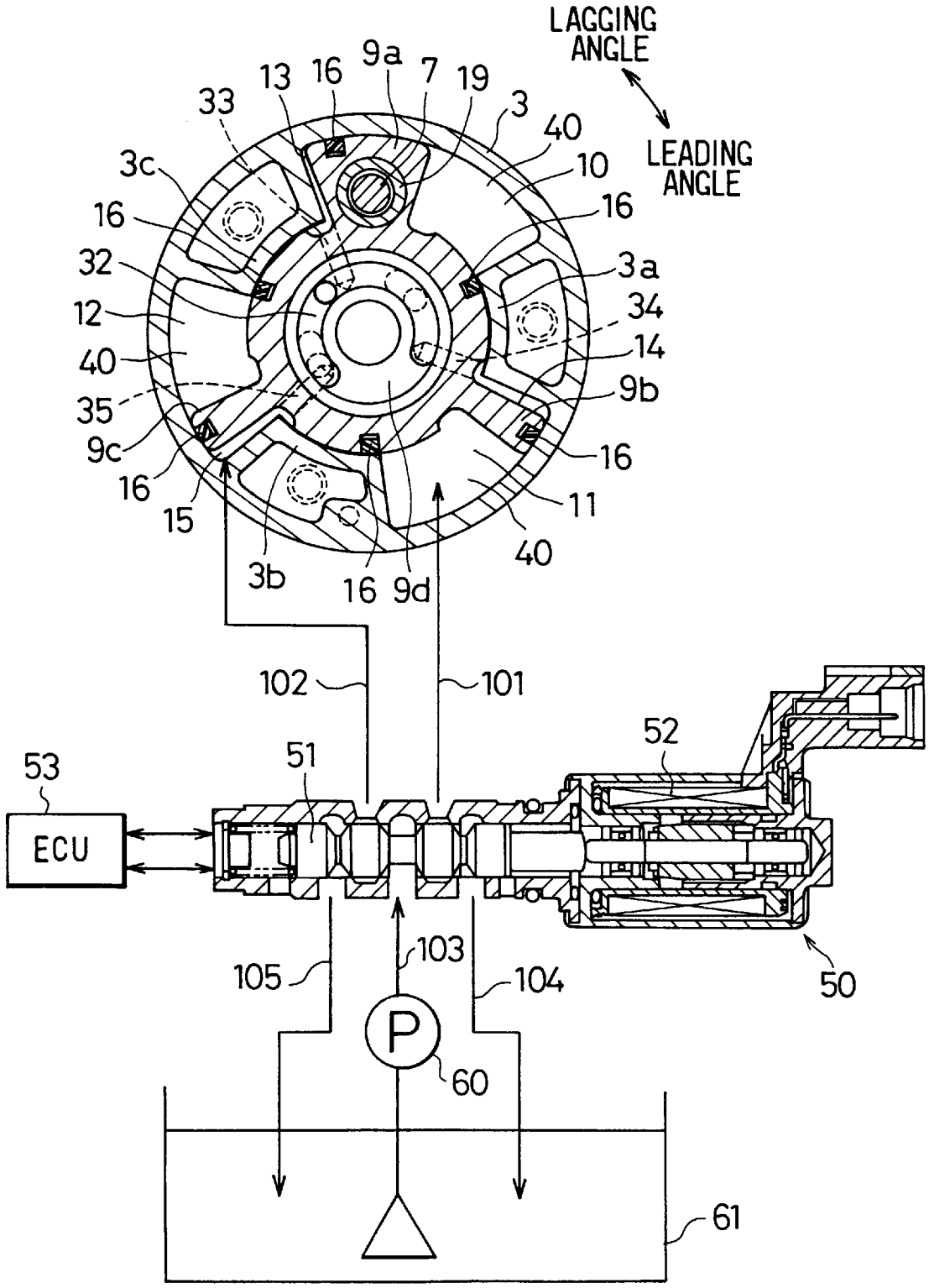
FIG. 1 is a diagram showing an I—I cross-sectional surface of a valve timing adjusting apparatus as implemented by a first embodiment of the present invention shown in FIG. 2.
Figure 2:
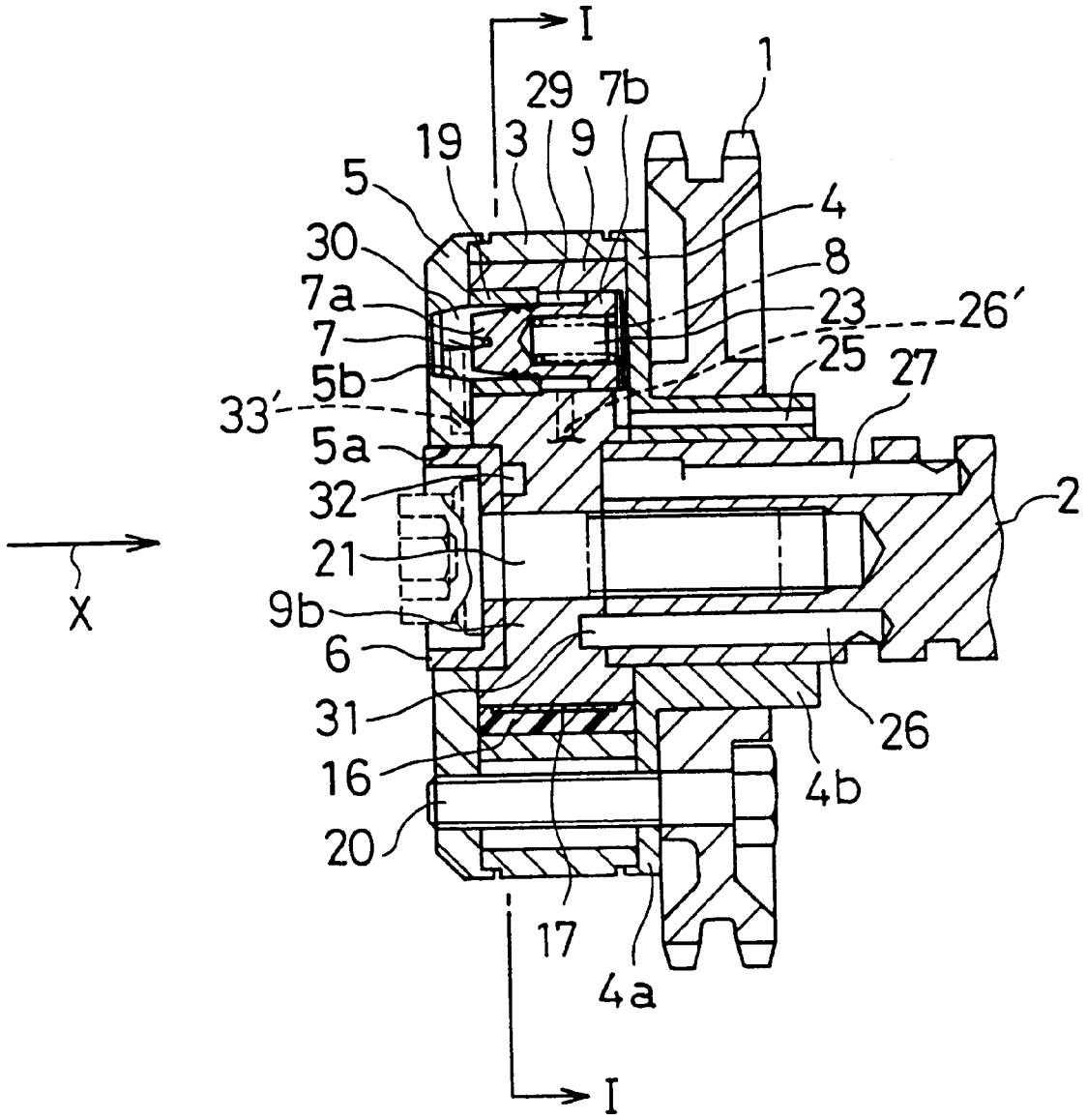
FIG. 2 is a diagram showing a cross section of the valve timing adjusting apparatus implemented by the first embodiment.
Figure 3:
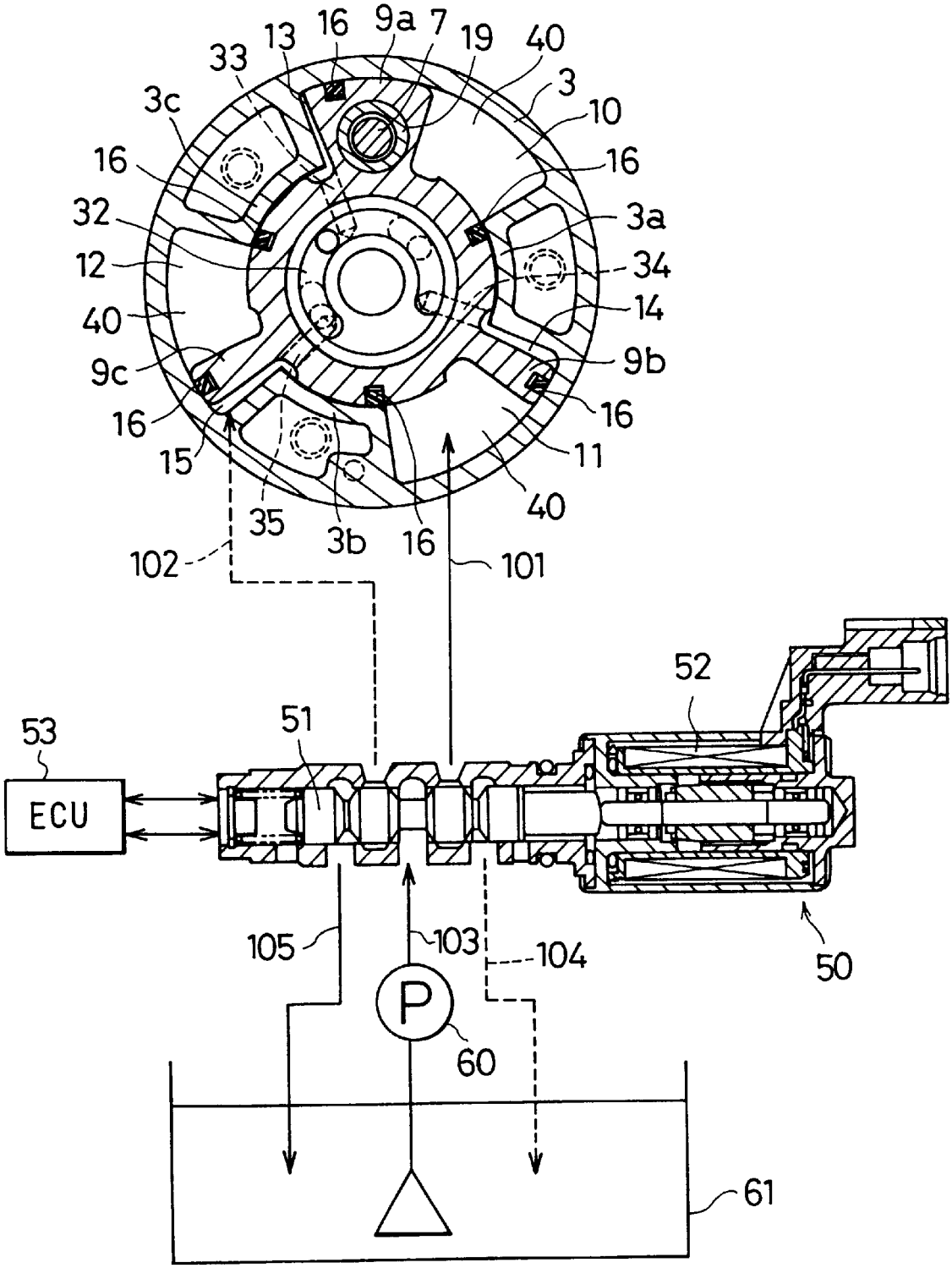
FIG. 3 is a diagram showing a cross section of the valve timing adjusting apparatus implemented by the first embodiment on a state immediately following a start of the engine at the same cross-sectional position as FIG. 1.

FIGS. 1 to 3 illustrate a valve timing adjusting apparatus for engines according to a first embodiment of the present invention. The valve timing adjusting apparatus implemented by the first embodiment adopts an oil pressure control technique for controlling valve timing of an intake valve.

A timing pulley 1 shown in FIG. 2 is linked to a crank shaft, a shaft driven by the engine not shown in the figure, by a timing belt also not shown. A driving force is transmitted from the crank shaft to the timing pulley 1, causing the timing pulley 1 to rotate in synchronization with the crank shaft. A rear member 4 comprises a plate portion 4*a* and a cylindrical portion4*b*. The timing pulley 1 is fit in the outer circumference of the cylindrical portion 4*b*. The driving force is transmitted from the timing pulley 1 to a camshaft 2 which is used as a driven shaft for opening and closing an intake valve not shown in the figure. The camshaft 2 is capable of rotating relatively at a predetermined difference in phase between the camshaft 2 and the timing pulley 1. The timing pulley 1 and the camshaft 2 rotate in the clockwise direction seen from the direction of an X arrow shown in FIG. 2. This rotational direction is referred to hereafter as a leading angular direction.

Surfaces of the two axial direction ends of a shoe housing 3 and a vane rotor 9 are covered by the plate portion 4*a* of the rear member 4 and a front plate 5. The timing pulley 1, the shoe housing 3, the rear member 4 and the front plate 5 constitute a rotary body on the driving side and are fixed to each other on the same shaft by bolts 20.

As shown in FIG. 1, on the inner circumferential surface of the shoe housing 3, shoes 3*a*, 3*b* and 3*c* each having a trapezoidal shape are provided at almost equal intervals in the circumferential direction. In each of three gaps between the shoes 3*a*, 3*b* and 3*c* in the circumferential direction, a fan-shaped space portion 40 is provided. The fan-shaped portions 40 are used as accommodation chambers for accommodating vanes 9*a*, 9*b* and 9*c* which each serve as a vane member. Each of the respective inner circumferential surfaces of the shoes 3*a*, 3*b* and 3*c* has a cross section resembling an arc.

The vane rotor 9 provides vanes 9*a*, 9*b* and 9*c* which have equal intervals in the circumferential direction thereof. Arrows shown in FIG. 1 indicate a lagging angular direction and a leading angular direction of the vane rotor 9 relative to the shoe housing 3. As shown in FIG. 2, the vane rotor 9 and a bushing 6 are fixed to the camshaft 2 by a bolt 21 to form an assembly serving as a rotary body on the driven side.

The camshaft 2 and the bushing 6 are fitted in the cylindrical portion 4*b* of the rear member 4 and an inner circumferential wall 5*a* of the front plate 5 respectively so that the camshaft 2 and bushing 6 are capable of rotating relative to the cylindrical portion and inner circumferential wall 5*a*. The cylindrical portion 4*b* of the rear member 4 and an inner circumferential wall 5*a* of the front plate 5 constitute a bearing of the rotary body on the driven side. Thus, the camshaft 2 and the vane rotor 9 can each be put in a state of relative rotation around a common axis with the timing pulley 1 and the shoe housing 3 taken as a reference respectively.

As shown in FIG. 1, seal members 16 are fit in the outer circumferential wall of the vane rotor 9. A small clearance is provided between the outer circumferential wall of the vane rotor 9 and the inner circumferential wall of the shoe housing 3. The seal members 16 are used for avoiding leakage of operating fluid to an oil pressure chamber by way of this clearance. The seal members 16 are each pressed against the inner circumferential wall of the shoe housing 3 by an energization force of a plate spring 17.

As shown in FIG. 2, a guide ring 19 is inserted into an accommodation bore 23, which is formed by an inner wall of the vane rotor 9*a*, to be held therein. A stopper piston 7 serving as an engaging portion is inserted into the guide ring 19. The stopper piston 7 comprises a cylindrical portion 7*a* having a bottom and a flange 7*b* provided on the opening part of the cylindrical portion 7*a*. The stopper piston 7 is accommodated in the guide ring 19 slidably in the axial direction of the camshaft 2 and pressed against the front plate 5 by a spring 8 which serves as pressing means. On the front plate 5, a stopper hole 5*b* is bored to be used as an engaged portion. The stopper piston 7 can be fit in the stopper hole 5*b*. With the stopper piston 7 put in an engaged state with the stopper hole 5*b*, the rotation of the vane rotor 9 relative to the shoe housing 3 is restrained.

An oil pressure chamber 29 on the left side of the flange 7*b* is linked to a lagging angle oil pressure chamber 10 to be described later by a hydraulic path 26'. On the other hand, an oil pressure chamber 30 formed on the front plate side of the cylindrical portion 7*a* is linked to a leading angle oil pressure chamber 13 also to be described later by a hydraulic path 33'. The area of a first oil pressure receiving surface of the cylindrical portion 7*a* for receiving a oil pressure generated by the oil pressure chamber 30 is set at a value larger than the area of a second oil pressure receiving surface of the flange 7*b* for receiving an oil pressure generated by the oil pressure chamber 29. Forces applied by operating fluid of the oil pressure chamber 30 to the first oil pressure receiving surface and applied by operating fluid of the oil pressure chamber 29 to the second oil pressure receiving surface work in a direction of pulling out the stopper piston 7 from the stopper hole 5*b*. The area of the first oil pressure receiving surface is almost equal to the cross-sectional area of the cylindrical portion 7*a*. On the other hand, the area of the second oil pressure receiving surface is about equal to the surface of a ring-shaped portion corresponding to a difference in radius between the flange 7*b* and the cylindrical portion 7*a*. When operating fluid having an oil pressure equal to or higher than a predetermined value is supplied to the lagging angle oil pressure chamber 10 or the leading angle oil pressure chamber 13, the stopper piston 7 is pulled out from the stopper hole 5*b* by the oil pressure of the operating fluid, resisting the energization force of the spring 8.

The positions of the stopper piston 7 and the stopper hole 5*b* are set so that, when the vane rotor 9 is located at a most lagging angular position with respect to the shoe housing 3, that is, when the camshaft 2 is rotated to a most lagging angular position with respect to the crank shaft, the stopper piston 7 can be fit in the stopper hole 5*b* by the energization force generated by the spring 8. In the first embodiment, the most lagging position is referred to as 'one of two circumferential direction ends of an accommodation chamber'. On the other hand, a most leading position is referred to as 'the other circumferential direction end of an accommodation chamber'.

Since a link path 25 formed on the cylindrical portion 4*b* is connected to an accommodation bore 23 on the rear member side rather than the flange 7*b* and also exposed to the atmosphere, the movement of the stopper piston 7 is not obstructed.

As shown in FIG. 1, lagging angle oil pressure chambers 10–12 are formed between the shoe 3*a* and the vane rotor 9*a* and between the shoe 3*b* and the vane rotor 9*b*, and between the shoe 3*c* and the vane rotor 9*c*, respectively. Leading angle oil pressure chambers 13–15 are formed between the shoe 3*c* and the vane rotor 9*a*, between the shoe 3*a* and the vane rotor 9*b*, and between the shoe 3*b* and the vane rotor 9*c*, respectively.

The link of an oil pressure path 101 connected to the lagging angle oil pressure chambers 10, 11 and 12 and the link of an oil pressure path 102 connected to the leading angle oil pressure chambers 13, 14 and 15 are cut off from an oil pressure path 103 or drain paths 104 and 105 by the movement of a spool 51 of an electromagnetic valve 50. The oil pressure path 103 is a path for supplying operating fluid pumped up from a drain 61 by a hydraulic pump 60. On the other hand, the drain paths 104 and 105 are paths for exhausting the operating fluid to the drain 61. An engine control unit 53 of the type well known in the art is used for controlling the position of the spool 51 by adjustment of the duty cycle of a control current supplied to a coil 52 of the electromagnetic valve 50 in accordance with the operating state of the engine. It should be noted that the engine control unit is referred to hereafter simply as an ECU.

As shown in FIG. 2, a boss 9*d* of the vane rotor 9 is provided with an oil pressure path 31 at an engaging portion of the camshaft 2 and a liquid path 32 at an engaging portion of the bushing 6. The oil pressure paths 31 and 32 are each formed to have an arcuate shape. The oil pressure path 31 and an oil pressure path 26 form part of the oil pressure path 101 shown in FIG. 1 and are linked to the lagging angle oil pressure chambers 10, 11 and 12 as well as the oil pressure chamber 29 by an oil pressure path 26'. The oil pressure of operating fluid supplied to the lagging angle oil pressure chambers 10, 11 and 12 is referred to as a second fluid pressure.

The oil pressure path 32 and an oil pressure path 27 form part of the oil pressure path 102 shown in FIG. 1 and are linked to the leading angle oil pressure chambers 13, 14 and as well as the oil pressure chamber 30 by oil pressure paths 33', 33, 34 and 35. The oil pressure of operating fluid supplied to the leading angle oil pressure chambers 13, 14 and 15 is referred to as a first fluid pressure.

The following is description of a relation between the duty cycle of the control current supplied to the electromagnetic valve 50 and the oil pressures applied to the lagging angle oil pressure chambers 10, 11 and 12 and the leading angle oil pressure chambers 13, 14 and 15.

Figure 4:
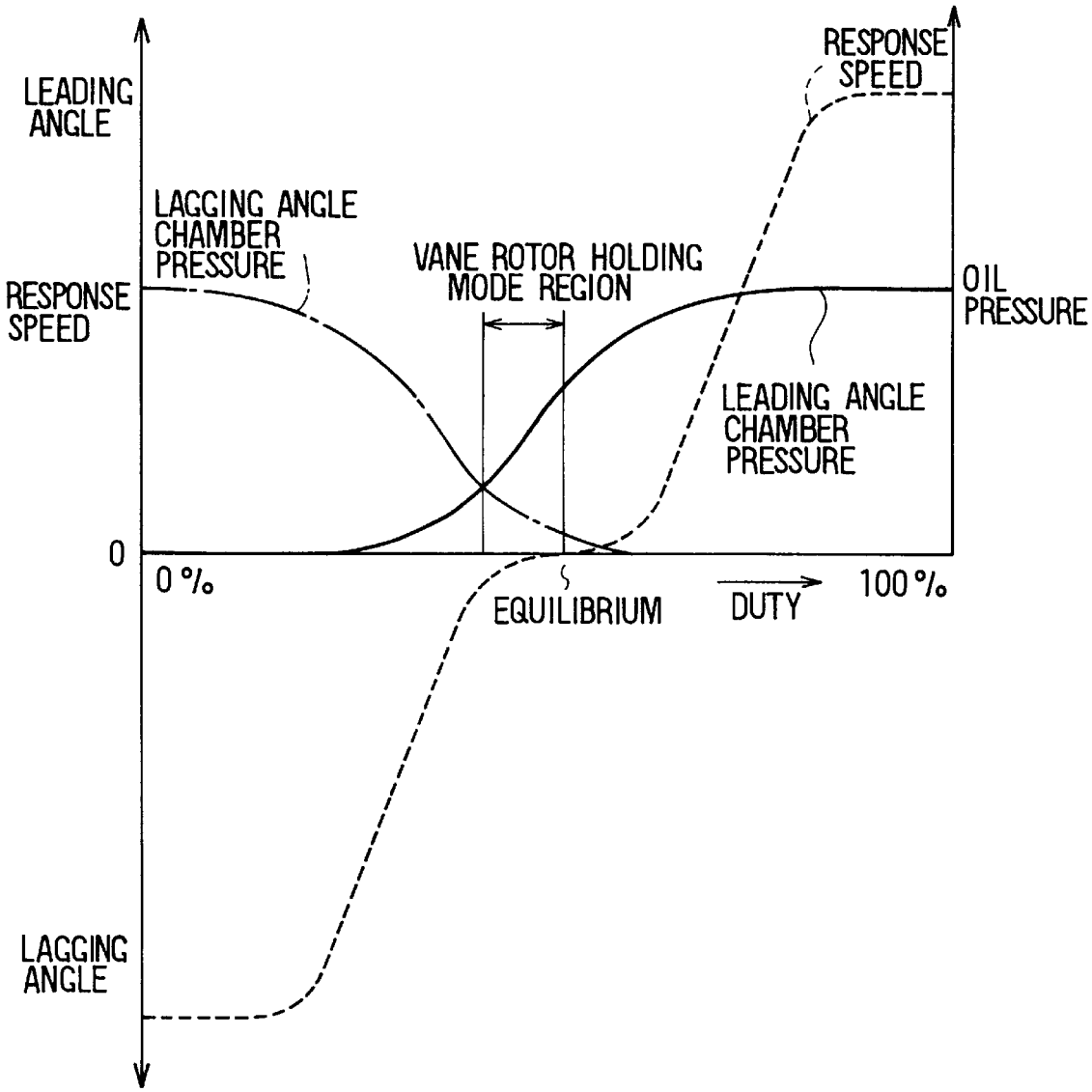
FIG. 4 is a diagram showing characteristics representing relations among a duty cycle, the oil pressure of a lagging angle oil pressure chamber and the oil pressure of a leading angle oil pressure chamber.

At a duty cycle of 0%, the spool 51 is located at a position shown in FIG. 3. In this state, the oil pressure of the operating fluid supplied to the lagging angle oil pressure chamber 10, 11 and 12 reaches a maximum value while no operating fluid is supplied to the leading angle oil pressure chambers 13, 14 and 15 as shown in FIG. 4.

As the duty cycle is increased, however, the spool 51 moves from the position shown in FIG. 3 to the left side. In this state, the oil pressure of the operating fluid supplied to the lagging angle oil pressure chamber 10, 11 and 12 is reduced and operating fluid is supplied to the leading angle oil pressure chambers 13, 14 and 15. Then, due to force experienced by each of the vanes 9*a*, 9*b* and 9*c* resulting from a difference in oil pressure between the lagging angle oil pressure chambers 10, 11 and 12 and the leading angle oil pressure chambers 13, 14 and 15, an equilibrium state is entered with an average value of positive and negative varying torques applied to the camshaft 2. The vane rotor 9 is held in an equilibrium state where the response speed is zero, causing the vane rotor 9 to rotate neither to the leading angle side nor to the lagging angle side as shown in FIG. 4. The equilibrium state is reached when the oil pressure of each of the leading angle oil pressure chambers 13, 14 and 15 is higher than the oil pressure of each of the lagging angle oil pressure chambers 10, 11 and 12 because the average value of the positive and negative varying torques applied to the camshaft 2 works toward the lagging angle side. When the duty cycle is further increased, the vane rotor 9 rotates to the leading angle side.

If the oil pressure of the oil pressure chamber 29 or the oil pressure chamber 30 is higher than a predetermined value, the stopper piston 7 is put in a state of being pulled out from the stopper hole 5*b* without regard to the value of the duty cycle.

In this way, by adjusting the duty cycle of the control current supplied to the electromagnetic valve 50, the oil pressure of each of the lagging angle oil pressure chambers 10, 11 and 12 and the leading angle oil pressure chambers 13, 14 and 15 can be controlled, allowing the phase of the vane rotor 9 relative to the shoe housing 3, that is, the phase of the camshaft 2 relative to the crank shaft, to be controlled.

Figure 5:
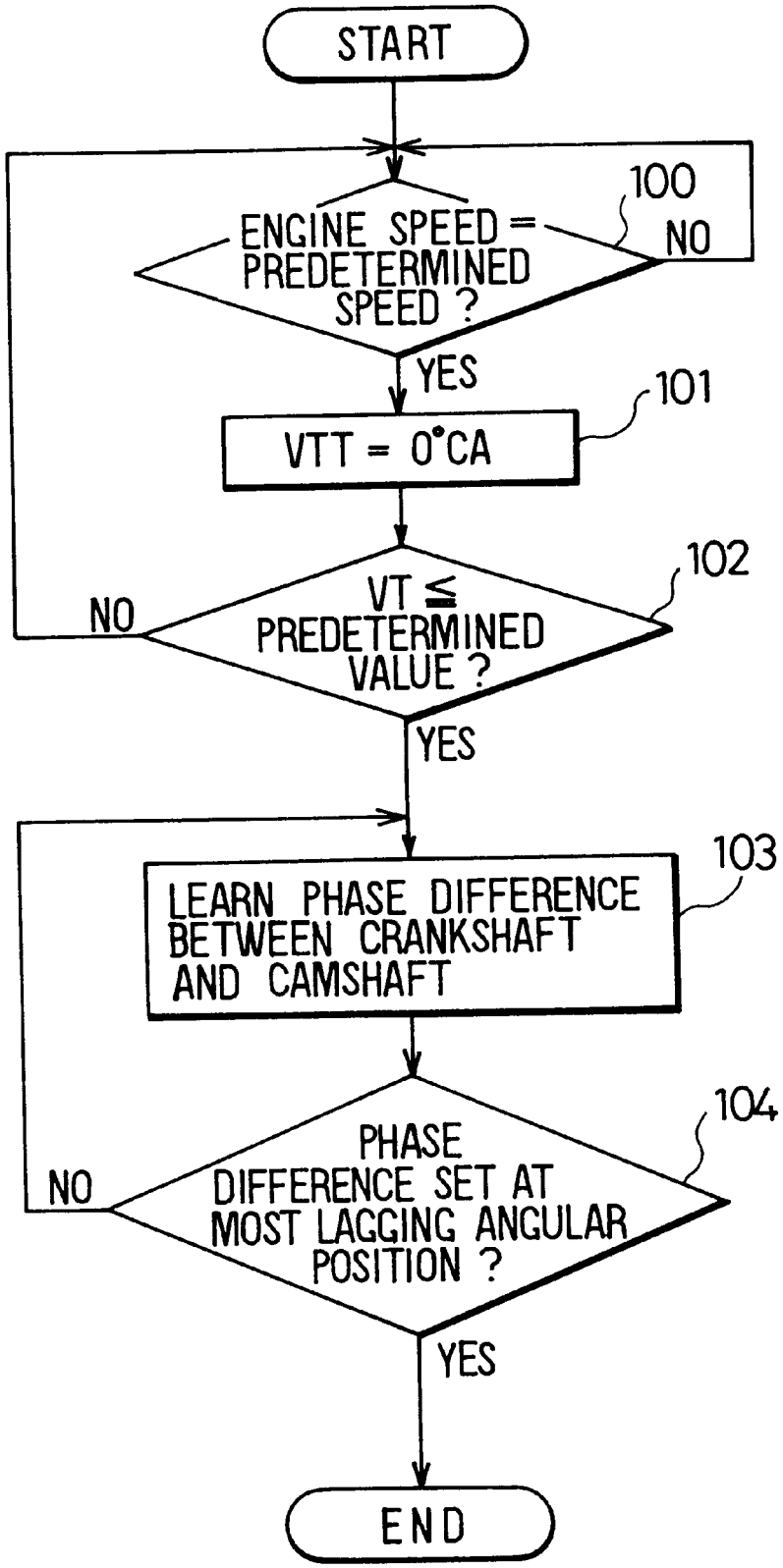
FIG. 5 is a flowchart representing a control routine executed by the first embodiment right after the start of the engine.
Figure 6:
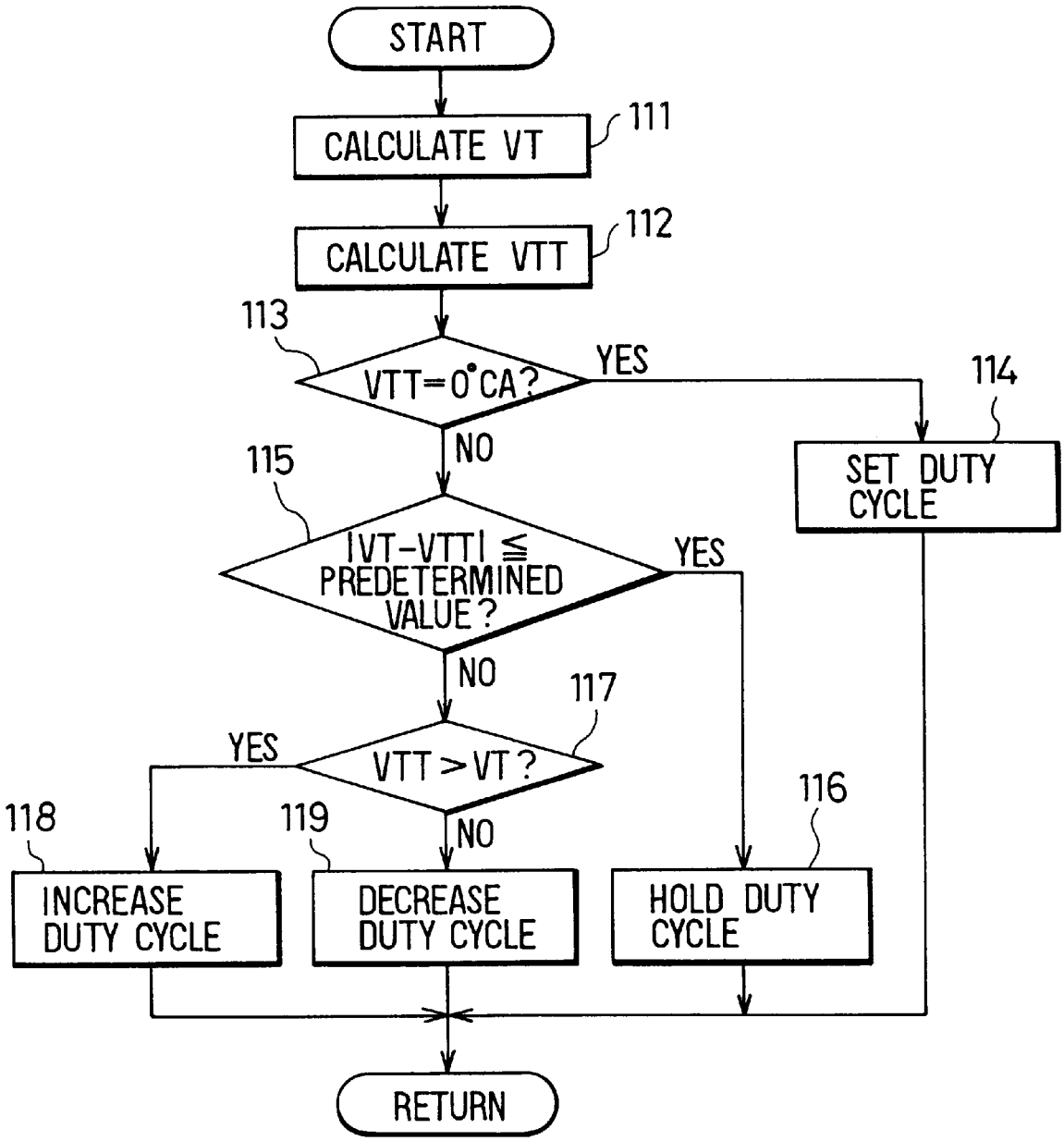
FIG. 6 is a flowchart representing a control routine periodically executed by the first embodiment.

Next, the actual oil pressure control is explained. FIGS. 5 and 6 are each a flowchart showing a control routine for controlling the phase of the vane rotor 9 relative to the shoe housing 3.

When the engine is started, the duty cycle of the control current supplied to the electromagnetic valve 50 is set at an initial value of 0%. Thus, the electromagnetic valve 50 is put in an oil pressure path switching state shown in FIG. 3. In this state, the oil pressure path 101 is linked to the oil pressure path 103 while the oil pressure path 102 is blocked by the spool 51. As a result, operating fluid can be supplied to each of the lagging angle oil pressure chambers 10, 11 and 12 and the oil pressure chamber 29. On the other hand, no operating fluid is supplied to each of the leading angle oil pressure chambers 13, 14 and 15 and the oil pressure chamber 30.

The ECU determines a difference in phase between the crank shaft and the camshaft 2 obtained at a duty cycle of 0% immediately following the start of the engine as a most lagging angular position of the vane rotor 9. Subsequent phase control is carried out with this determined difference in phase used as a reference value. In order to correctly obtain the difference in phase used as the reference value, it is necessary to correctly hold the vane rotor 9 at the most lagging angular position with respect to the shoe housing 3. In a state where the operating fluid from the hydraulic pump 60 has not been sufficiently introduced right after the start of the engine, however, it is difficult to control the position of the vane rotor 9 relative to the shoe housing 3 by using the oil pressure with a high degree of reliability.

In a system wherein the operation of the engine is ended after the vane rotor 9 has been held at the most lagging angular position and the stopper piston 7 has been put in an engaged state with the stopper hole 5*b*, the rotational speed of the engine is low right after the start of the engine, not even achieving a value in the range of the idle rotational speed. In this case, since the stopper piston 7 has been put in an engaged state with the stopper hole 5*b* even if the operating fluid from the hydraulic pump 60 has not been sufficiently introduced yet to the lagging angle oil pressure chambers 10 to 12 and the oil pressure chamber 29, the vane rotor 9 is held at the most lagging angular position with a high degree of reliability. As a result, no impact sound is generated by a collision of any of the vanes 9*a* to 9*c* with any of the shoes 3*a* to 3*c* caused by movement of the vane rotor 9. In a system wherein the operation of the engine is ended without putting the stopper piston 7 in an engaged state with the stopper hole 5*b* by force, on the other hand, the engine may be started with the stopper piston 7 not engaged with the stopper hole 5*b* in some cases. Also in this case, the average value of positive and negative varying torques applied to the camshaft 2 works as an energization force to rotate the vane rotor 9 to the lagging angle side. The vane rotor 9 thereby rotates toward the lagging angle side, allowing the stopper piston 7 to be fit in the stopper hole 5*b*, with the operating fluid from the hydraulic pump 60 not sufficiently introduced to the lagging angle oil pressure chambers 10 to 12 and the oil pressure chamber 29. If the vane rotor 9 rotates, reaching the most lagging angular position, the stopper piston 7 is fit in the stopper hole 5*b*, holding the vane rotor 9 at the most lagging angular position without generating impact sound.

With the stopper piston 7 put in an engaged state with the piston hole 5*b* and without regard to whether or not the vane rotor 9 is held at the most lagging angular position, the ECU waits until the rotational speed of the engine increases to a value in the range of the idle rotational speed. The vane rotor 9 can then be held at the most lagging angular position by means of oil pressure control with a high degree of reliability by sufficiently introducing operating fluid to the lagging angle oil pressure chambers. The control routine represented by the flowchart shown in FIG. 5 is a routine which is executed immediately after the engine has been started. As shown in the figure, the flowchart starts with a step 100 at which the ECU enters the wait state described above. Even if operating fluid has been sufficiently introduced to the lagging angle oil pressure chambers 10 to 12 as well as the oil pressure chamber 29, and the stopper piston 7 is pulled out from the stopper hole 5*b*, thereby resisting the energization force of the spring 8, so that the condition securing the vane rotor 9 and the shoe housing 3 is removed, the vane rotor 9 is held at the most lagging angular position relative to the shoe housing 3. The vane rotor is held at this position by a force attributed to a difference in oil pressure between the lagging angle oil pressure chambers 10 to 12 and the leading angle oil pressure chambers 13 to 15, and a force attributed to the average value of positive and negative varying torques applied to the camshaft 2, as the duty cycle of the control current supplied to the electromagnetic valve 50 is set at 0%.

As the rotational speed of the engine increases to a value in the range of idle rotational speed, the routine proceeds to step 101 at which a target leading angle quantity referred to hereafter simply as a VTT is set at 0 degrees CA. Setting the VTT at 0 degrees CA means holding the vane rotor 9 at the most lagging angular position.

The routine then proceeds to step 102 and determines whether the vane rotor 9 is held at the most lagging angular position by oil pressures generated by the lagging angle oil pressure chambers 10 to 12, even if positive and negative varying torques are applied to the camshaft 2, by determining whether variations in actual leading angle quantity, referred to hereafter simply as VT, are equal to or smaller than a predetermined value. This determination is used to verify that the vane rotor 9 in actuality does not move from the most lagging angular position. For example, even if the stopper piston 7 is fit in the stopper hole 5*b*, the most lagging angular position of the vane rotor 9 may be shifted due to friction of the stopper piston 7 or the stopper hole 5*b*. In this case, the shifted state of the position will be detected as an outcome of the determination of step 102.

If the outcome of the determination of step 102 indicates that the vane rotor 9 is held at the most lagging angular position, the routine continues to step 103 at which the difference in phase between the crank shaft and the camshaft 2 is learned as the most lagging angular position. The difference in phase is used as a reference value in the subsequent phase control. The routine then proceeds to step 104 at which the difference in phase at the most lagging angular position is set before ending the processing represented by the routine shown in FIG. 5.

The control routine represented by the flowchart shown in FIG. 6 is a control routine executed periodically by invoking timer interrupts in a normal operating state after the execution of the control routine shown in FIG. 5. In the control routine shown in FIG. 6, the phase of the vane rotor 9 relative to the shoe housing 3 is controlled through adjustment of the oil pressure of operating fluid supplied to each of the lagging angle oil pressure chambers 10 to 12 and the leading angle oil pressure chambers 13 to 15 by variation of the duty cycle of the control current supplied to the electromagnetic valve 50 in accordance with the operating state of the engine.

The control routine begins with step 111 where the VT is calculated. The routine then proceeds to step 112 at which time the VTT is calculated in accordance with the operating state of the engine. Then, the routine proceeds to step 113 where a determination as to whether or not the VTT is 0 degrees CA. If the VTT is found equal to 0 degrees CA, the routine continues to step 114 at which the duty cycle is set at a value resulting from subtraction of a predetermined value ALPHA from a duty cycle for a response speed of 0 relative to the shoe housing shown in FIG. 4, that is, a duty cycle for the vane rotor 9 in an equilibrium state with the shoe housing 3.

The value of duty cycle set at step 114 is smaller than the value of a duty cycle for holding the vane rotor 9 in an equilibrium state relative to the housing shoe 3, where the vane rotor 9 does not rotate to the leading angle side and the lagging angle side as shown in FIG. 4. The value of the duty cycle set at step 114 is also greater than the value of a duty cycle providing an oil pressure of each of the lagging angle oil pressure chambers 10 to 12 equal to the oil pressure of the leading angle oil pressure chambers 13 to 15. This duty cycle causes the spool 51 to move from a position shown in FIG. 3 to the left to a state shown in FIG. 1. In this state, the oil pressure path 102 is also linked to the oil pressure path 103 in addition to the oil pressure path 101. At that time, a resultant force applied to each of the vanes 9*a* to 9*c*, that is, a force attributed to a difference in oil pressure between the lagging angle oil pressure chambers 10 to 12 and the leading angle oil pressure chambers 13 to 15, and the average value of the positive and negative varying forces applied to the camshaft 2, works as an energization force to push each of the vanes 9*a* to 9*c* toward the lagging angle side as before. As a result, each of the vanes 9*a* to 9*c* is held at the most lagging angular position shown in FIG. 1, that is, one of the circumferential direction ends of the accommodation chamber 40.

Thus, each of the vanes 9*a* to 9*c* is prevented from moving, thereby suppressing generation of impact sound due to collisions of the vanes 9*a* to 9*c* with the shoes 3*a* to 3*b* even if the positive and negative varying torques are applied to the camshaft 2. In addition, since an oil pressure is applied to each of the lagging angle oil pressure chambers 10 to 12 in advance, by merely increasing the oil pressure of operating fluid supplied to each of the leading angle oil pressure chambers 13 to 15 without the need to switch the oil pressure path, the vane rotor 9 can be rotated from the most lagging angular position to the leading angle side. Moreover, in an end holding mode at step 114 for holding the vane rotor 9 at the most lagging angular position, oil pressures from both the lagging angle oil pressure chamber 10 and the leading angle oil pressure chamber 13 are applied to the stopper piston 7 to pull out the stopper piston 7 from the stopper hole 5*b*. As a result, when the vane rotor 9 is rotated from the most lagging angular position to the leading angle side, it is possible to avoid damaging the stopper 7 and the stopper hole 5*b*.

If the outcome of the determination of step 113 indicates that the VTT is not equal to 0 degrees CA, the routine proceeds to step 115 to form a determination as to whether or not the absolute value of a difference between the VT and the VTT is equal to or smaller than a predetermined value, that is, a determination as to whether or not the difference in phase between the shoe housing 3 and the vane rotor 9 has reached a value close to the VTT. If the absolute value of the difference is found equal to or smaller than the predetermined value, the routine proceeds to step 116 where the duty cycle of the control current supplied to the electromagnetic valve 50 is held as a learned duty cycle with no changes. The learned duty cycle will be used as a duty cycle of the control current. The absolute value of a difference between the VT and the VTT equal to or smaller than a predetermined value means that the vane rotor 9 is located at a target leading angular position. The processing carried out at step 116 for sustaining this position is referred to as processing in a holding mode.

If the outcome of the determination of step 115 indicates that the absolute value of the difference between the VT and the VTT is greater than the predetermined value, that is, if the difference in phase between the vane rotor 9 and the shoe housing 3 has not reached a value close to the VTT, the routine proceeds to step 117 to form a determination as to whether or not the VTT is greater in magnitude than the VT by comparing the former with the latter. If the VTT is found greater than the VT (VTT>VT), the routine proceeds to step 118 where the duty cycle is increased to move forward the vanes 9*a* to 9*c* to a more leading angle. The processing carried out at step 118 is referred to as processing in a leading angle mode, and is adopted as a first mode.

If the outcome of the determination of step 117 indicates that the VTT is smaller than the VT (VTT<VT), the routine proceeds to step 119 where the duty cycle is decreased to move backward the vanes 9*a* to 9*c* to a more lagging angle.

The processing carried out at step 119 is referred to as processing in a lagging angle mode, and is adopted as a second mode. The processing carried out at steps 115, 117, 118 and 119 to rotate the vane rotor 9 to the lagging angle side or the leading angle side in accordance with the relation between the VTT and VT are referred to as processing in an F/B (feedback) mode.

In the first embodiment, by providing the stopper piston 7 with oil pressure receiving surfaces for receiving oil pressures of both the lagging angle side and the leading angle side, with operating fluid introduced from the hydraulic pump 60, the stopper piston 7 can be pulled out from the stopper hole 5*b* with a high degree of reliability without regard to the duty cycle of the control current supplied to the electromagnetic valve 50.

(SECOND EMBODIMENT)

Figure 7:
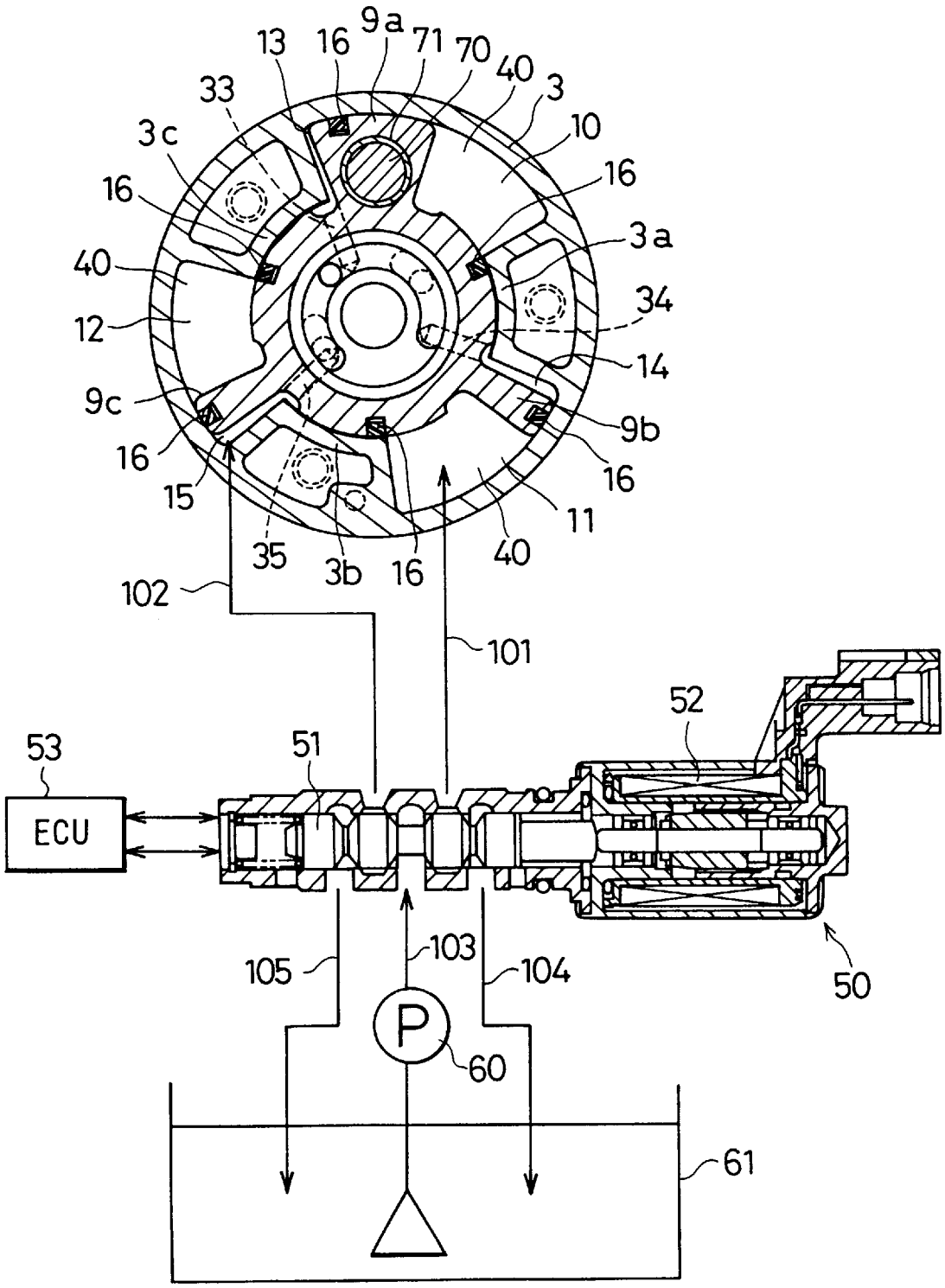
FIG. 7 is a diagram showing a VII—VII cross-sectional surface of a valve timing adjusting apparatus as implemented by a second embodiment of the present invention shown in FIG. 8.
Figure 8:
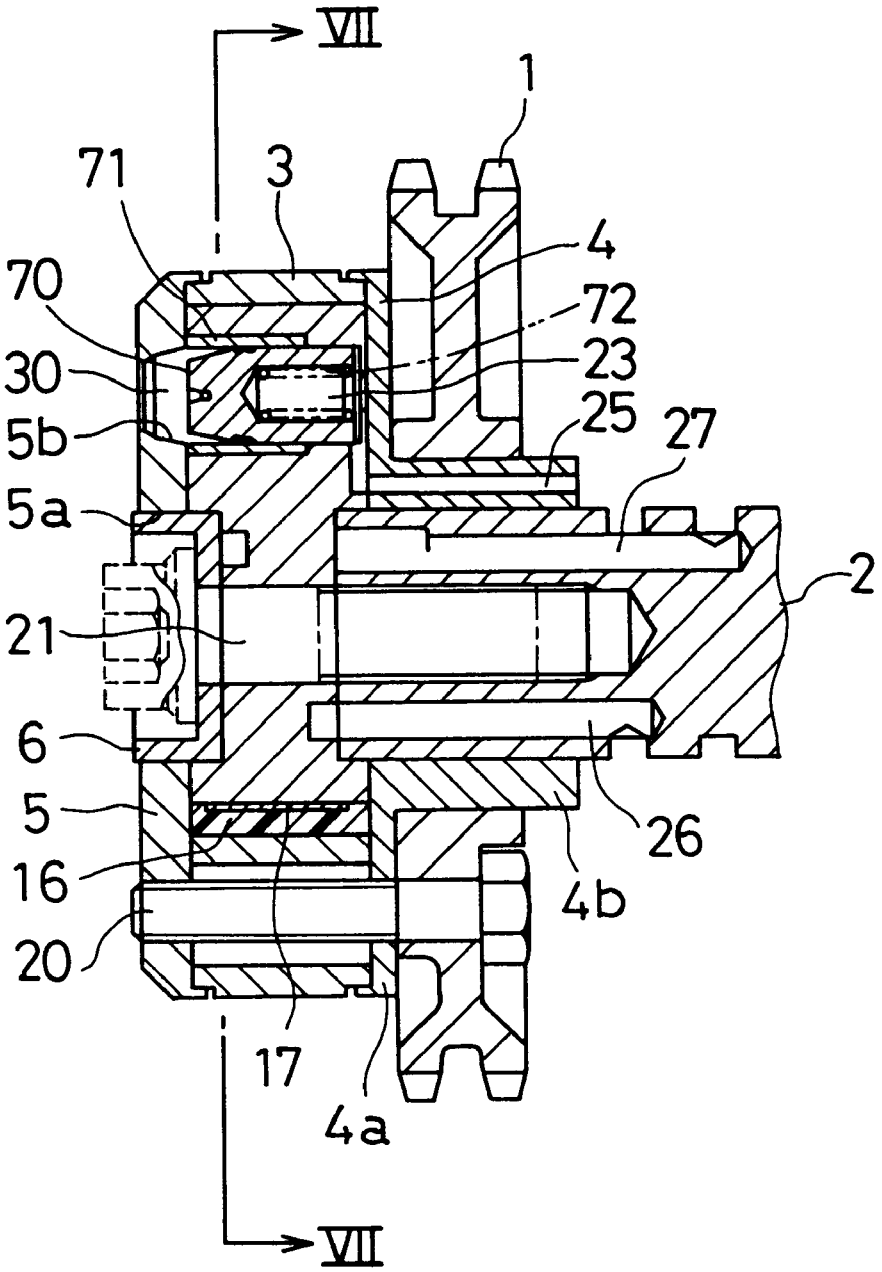
FIG. 8 is a diagram showing a cross section of the valve timing adjusting apparatus implemented by the second embodiment.

A second embodiment of the present invention is shown in FIGS. 7 and 8. Components virtually identical with those employed in the first embodiment are denoted by the same reference numerals as the latter.

A stopper piston 70 employed in the second embodiment is formed to have an almost uniform external radius along the axial direction thereof and supported by a guide ring 71 so that the stopper piston 70 can be moved back and forth. Oil pressure from only the oil pressure chamber 30 is applied to the stopper piston 70 to pull out the stopper piston 70 from the stopper hole 5*b*,and to overcome the force of a spring 72. For this reason, the area of an oil pressure receiving surface for receiving the oil pressure from the oil pressure chamber 30 can be made larger than that of the stopper piston 7 employed in the first embodiment.

Also in the case of the second embodiment, the phase control of the vane rotor 9 relative to the shoe housing 3 is carried out by using the control routines represented by the flowcharts shown in FIGS. 5 and 6 which have already been explained for the first embodiment. In the case of the second embodiment, however, no force is applied to the stopper piston 70 from an oil pressure for rotating the vane rotor 9 to the lagging angle side. As a result, when the rotational speed of the engine reaches a value in the range of the idle rotational speed after engine start-up, thereby placing the vane rotor 9 at the most lagging angular position, in a state prior to the execution of the end holding mode, the stopper piston 70 is fit in the stopper hole 5*b*. Then, as the end holding mode is executed, the stopper piston 70 is pulled out from the stopper hole 5*b* by oil pressure in the oil pressure chamber 30, allowing the phase control of the vane rotor 9 relative to the shoe housing 3 to be carried out.

As described above, the stopper piston 70 employed in the second embodiment is formed to have an almost uniform external radius along the axial direction thereof, making the fabrication of the stopper piston 70 simple and, hence, allowing the manufacturing cost to be reduced.

In addition, in the case of the first embodiment, the stopper piston is provided with oil pressure receiving surfaces for receiving oil pressures from both the lagging angle side and the leading angle side. In such a case, when the rotational speed of the engine decreases, reducing the oil pressure of operating fluid, the stopper piston 7 may be fit in the stopper hole 5*b* at the most lagging angular position. In order to avoid this problem, the radius of the stopper piston 7 and the areas of the oil pressure receiving surfaces provided thereto can be increased. However, such a solution gives rise to another problem that the valve timing adjusting apparatus becomes larger in size. As an alternative to the solution described above, increasing the driving force of the hydraulic pump 60 is conceivable. However, this alternative solution raises a problem of an increased load on the engine which in turns reduces the fuel consumption efficiency.

In the case of the second embodiment, on the other hand, the area of the oil pressure receiving surface for receiving an oil pressure on the leading angle side can be increased. As a result, the stopper piston 70 can be pulled out from the stopper hole 5*b* with a high degree of reliability even if the rotational speed of the engine decreases, lowering the oil pressure on the leading angle side.

In the embodiments of the present invention described above, right after the engine is started and before the vane rotor 9 is rotated from the most lagging angular position to the leading angle side, the stopper piston is pulled out from the stopper hole 5*b* in advance in an end holding mode in order to remove a restrained state of the shoe housing 3 and the vane rotor 9. As a result, damage to the stopper piston and the stopper hole 5*b* due to the rotation of the vane rotor 9, with the stopper piston in an engaged state with the stopper hole 5*b*, can be prevented.

In addition, in the end holding mode where the vane rotor 9 is placed at the most lagging angular position, the oil pressure of each of the leading angle oil pressure chambers 13 to 15 in the end holding mode is lower than the oil pressure of each of the leading angle oil pressure chambers 13 to 15 in a leading angle mode for rotating the vane rotor 9 to the leading angle side even if the bound state of the shoe housing 3 and the vane rotor 9 is removed. Thus, the vane rotor 9 is pressed toward the lagging angle side. As a result, at the most lagging angular position, a housing member can be prevented from colliding with a vane member even if positive and negative variations in torque are applied to the camshaft 2.

Furthermore, the value of the control current duty cycle supplied to the electromagnetic valve 50 is set at a value smaller than the value of a duty cycle for holding the vane rotor 9 in an equilibrium state relative to the housing shoe 3, where the vane rotor 9 does not rotate to the leading angle side and the lagging angle side as shown in FIG. 4, but greater than the value of a duty cycle providing an oil pressure of each of the lagging angle oil pressure chambers 10 to 12 equal to the oil pressure of the leading angle oil pressure chambers 13 to 15. As a result, when the vane rotor 9 is rotated from the most lagging angular position to the leading angle side, by merely increasing the oil pressure of each of the leading angle oil pressure chambers 13 to 15 slightly, the vane rotor 9 can be rotated to the leading angle side, thereby improving the response characteristic of the phase control from the most lagging angular position to the leading angle side.

In addition, the embodiments of the present invention each have a configuration wherein the stopper piston is moved in the axial direction of the vane rotor 9, entering an engaged state with the stopper hole 5*b* provided on the front plate housing member 5. It should be noted, however, that the embodiments can be modified into a configuration wherein, for example, the stopper piston is accommodated in the shoe housing and the stopper piston is moved in the radial direction of the shoe housing to enter an engaged state with a stopper hole bored through a vane rotor.

Moreover, the embodiments of the present invention each have a configuration wherein a rotation driving force generated by the crank shaft is transmitted by the timing pulley to the camshaft as described above. However, the embodiments can be modified to a configuration wherein a chain sprocket or a timing gear is employed as a substitute for the timing pulley, or to a configuration wherein a driving force generated by the crank shaft serving as a driving shaft is received by a vane member for rotating the camshaft serving as a driven shaft and the housing member as a single body.

In addition, the embodiments of the present invention each implement a valve timing adjusting apparatus for driving an intake valve as described above. However, the valve timing adjusting apparatus can also be used for driving an exhaust valve or for driving both the intake and exhaust valves as well. When the valve timing adjusting apparatus is used for adjusting an exhaust valve, the stopper piston can be fit in the stopper hole 5*b* to execute an end holding mode at the time the vane rotor 9 is located at the most leading angular position relative to the shoe housing 3. In addition, the stopper piston is provided with an oil pressure receiving surface for receiving a force from only an oil pressure on the lagging angle side.

Moreover, in the embodiments of the present invention, in order to end the operation of an engine, the vane rotor 9 is held at the most lagging angular position relative to the shoe housing 3 and the stopper piston is fit in the stopper hole 5*b* by an energization force generated by the spring 8. As an alternative, the operation of the engine can also be ended by putting the vane rotor 9 in a halted state at a position other than the most lagging angular position.

What is claimed is:

1. A vane-type hydraulically adjustable phase rotational drive apparatus having at least one accommodating chamber defined between two relatively rotatable members, one of said rotatable members comprising a housing and the other of said rotatable members comprising a rotor, intermeshed projections of said two relatively rotatable members including a vane member of said rotor cooperatively defining a leading fluid chamber and a lagging fluid chamber within said accommodating chamber, a volume of each of which is variable in accordance with a rotational position of said rotor with respect to said housing, a relative imbalance between the magnitudes of fluid volumes supplied to said leading and lagging chambers causing corresponding relative rotary forces between said relatively rotatable members, said apparatus further comprising:

a fluid supply controller means for selectively adjusting a first fluid supply to press said vane member toward a first of two circumferential ends of said accommodation chamber, and for selectively adjusting a second fluid supply to press the vane member toward a second of said two circumferential ends of the accommodation chamber;

said controller means having a first, end holding mode in which the vane member is held at the first end of the accommodation chamber and a second mode in which the vane member is rotated toward the second end of the accommodation chamber;

a fluid pressure of said second fluid supply in the end holding mode being lower than a fluid pressure of said second fluid supply in the second mode, said fluid pressure of said second fluid supply in the end holding mode being higher than a fluid pressure of said first fluid supply in the end holding mode; and a motion restraining means having a first restrained state for preventing relative motion between said relatively rotatable members and a second un-restrained state for permitting relative motion between said relatively rotatable members;

wherein the restrained state is removed by a fluid force, including at least the second fluid supply pressure in the end holding mode, that opposes a force generated by a bias member of said restraining means.

2. A method for controlling a vane-type hydraulically adjustable phase rotational drive apparatus having at least one accommodating chamber defined between two relatively rotatable members, one of said rotatable members comprising a housing and the other of said rotatable members comprising a rotor, intermeshed projections of said two relatively rotatable members including a vane member of said rotor cooperatively defining a leading fluid chamber and a lagging fluid chamber within said accommodating chamber, a volume of each of which is variable in accordance with a rotational position of said rotor with respect to said housing, a relative imbalance between fluid volume magnitudes of said leading and lagging chambers causing corresponding relative rotary forces between said relatively rotatable members, said method comprising:

adjusting a first fluid supply to press said vane member toward a first of two circumferential ends of said accommodation chamber, and adjusting a second fluid supply to press the vane member toward a second of the two circumferential ends of the accommodation chamber;

holding the vane member at the first end of the accommodation chamber in a first, end holding mode and rotating the vane member toward the second end of the accommodation chamber in a second mode, a fluid pressure of said second fluid supply in said end holding mode being lower than a fluid pressure of said second fluid supply in the second mode, said fluid pressure of said second fluid supply in the end holding mode being higher than a fluid pressure of said first fluid supply in the end holding mode; and preventing relative motion between said relatively rotatable members in a first restrained state and permitting relative motion between said relatively rotatable members in a second un-restrained state;

wherein the restrained state is removed by a fluid force, including at least the second fluid supply pressure in the end holding mode, that opposes a force generated by a bias member.

3. A method as in claim 2 further comprising:

providing a spring biased locking mechanism as said bias member, and disposed on at least one of said relatively rotatable members to lock them against relative rotation when fluid pressures of said first and second fluid supplies are below a predetermined magnitude, said spring-biased locking mechanism including first and second surfaces respectively communicated with said first and second fluid supplies which each act to hydraulically move said mechanism against its spring bias force and thus unlock said relatively rotatable members for relative rotation when a fluid pressure of at least one of said first and second fluid supplies is above a predetermined magnitude.

4. A method as in claim 2 including:

controllably modulating the duty cycle at which fluid is supplied to said lagging and leading fluid chambers.

5. A method as in claim 2 wherein the first fluid supply is supplied to the lagging angle chamber and wherein the second fluid supplied is supplied to the leading angle chamber.

6. A vane-type hydraulically adjustable phase rotational drive apparatus having at least one accommodating chamber defined between two relatively rotatable members, one of said rotatable members comprising a housing and the other of said rotatable members comprising a rotor, intermeshed projections of said two relatively rotatable members including a vane member of said rotor cooperatively defining a leading fluid chamber and a lagging fluid chamber within said accommodating chamber, a volume of each of which is variable in accordance with a rotational position of said rotor with respect to said housing, a relative imbalance between the magnitudes of fluid volumes supplied to said leading and lagging chambers causing corresponding relative rotary forces between said relatively rotatable members, said apparatus further comprising:

a fluid supply controller which selectively adjusts a first fluid supply to press the vane member toward a first of two circumferential ends of said accommodation chamber, and selectively adjusts a second fluid supply to press the vane member toward a second of the two circumferential ends of the accommodation chamber;

said controller having a first, end holding mode in which the vane member is held at the first end of the accommodation chamber and a second mode in which the vane member is rotated toward the second end of the accommodation chamber;

a fluid pressure of said second fluid supply in the end holding mode being lower than a fluid pressure of said second fluid supply in the second mode, said fluid pressure of said second fluid supply in the end holding mode being higher than a fluid pressure of said first fluid supply in the end holding mode; and a motion restraining device having a first restrained state which prevents relative motion between said relatively rotatable members and a second un-restrained state which permits relative motion between said relatively rotatable members;

wherein the restrained state is removed by a fluid force, including at least the fluid pressure of said second fluid supply in the end holding mode, that opposes a force generated by a bias member.

7. The apparatus of claim 6, wherein said motion restraining device comprises:

an axially slidable piston housed in an accommodation bore formed in the vane member, a piston receiving bore formed in said housing, and the bias member comprises a spring that outwardly biases the piston toward the piston receiving bore.

8. The apparatus of claim 7, wherein:

the piston further includes a flange thereon, the piston accommodation bore and the flange defining a first piston fluid pressure chamber therebetween, the piston also defining a piston surface that, together with the housing, define a second piston fluid pressure chamber therebetween.

9. The apparatus of claim 8, further comprising:

a fluid supply in fluid communication with the first and second piston fluid pressure chambers, the fluid supply selectively supplying fluid in a pressurized manner to control movement of the piston between an engaged and a disengaged position when the piston and the piston receiving bore are axially aligned.

10. The apparatus of claim 9, wherein:

the piston surface has a surface area that is greater than the piston flange surface area.

11. The apparatus of claim 9, wherein:

the controller causes the vane member to rotate from a most lagging angular position to a most leading angular position by changing the volume of pressurized fluid supplied to the first and second fluid pressure chambers in response to predetermined engine control parameters.

12. The apparatus of claim 11, further comprising:

an electromagnetic supply valve actuated by the controller to selectively supply fluid from a fluid supply to the first and second fluid pressure chambers.

13. The apparatus of claim 12, wherein:

the predetermined engine control parameters include a supply valve duty control cycle that is initially set at 0% during engine start up, and the engine control unit learns a difference in phase between the two relatively rotatable members at the 0% duty control cycle as the most lagging angular position of the vane member for subsequent vane member rotational control.

14. The apparatus of claim 11, wherein:

the piston engages the piston receiving bore in conjunction with rotation of the vane member to the most lagging angular position.

15. An apparatus as in claim 6 wherein said fluid supply controller includes a valve which controllably modulates the duty cycle at which fluid is supplied to said leading and lagging fluid chambers thereby controlling said second and first fluid pressures respectively.

16. Apparatus as in claim 6 wherein:

said motion restraining device having a controllable locking mechanism disposed between said relatively rotatable members and having first and second hydraulically actuated surfaces in respective fluid communication with said lagging and leading chambers, each of said hydraulically actuated surfaces exerting a force tending to unlock said members and thus permit relative rotation unless the fluid pressures in both said chambers are below a predetermined value, whereupon said mechanism locks said two members together in a predetermined fixed relative rotational phase position.

17. Apparatus as in claim 6 wherein the first fluid supply is supplied to the lagging angle chamber and wherein the second fluid supplied is supplied to the leading angle chamber.

* * * * *